United States Patent [19]

Jones

[11] Patent Number: 4,751,966

[45] Date of Patent: Jun. 21, 1988

[54] USE OF A GEL ABOVE A CONTROLLED PULSE FRACTURING DEVICE

[75] Inventor: Lloyd G. Jones, Dallas, Tex.

[73] Assignee: Mobil Oil Corporation, New York, N.Y.

[21] Appl. No.: 941,135

[22] Filed: Dec. 12, 1986

[51] Int. Cl.[4] ..... E21B 43/263

[52] U.S. Cl. ..... 166/299; 166/308

[58] Field of Search ..... 166/63, 177, 299, 300, 166/308

[56] References Cited

U.S. PATENT DOCUMENTS

| | | | |
|---|---|---|---|
| 2,676,662 | 4/1954 | Ritzmann | 166/299 |
| 2,766,828 | 10/1956 | Rachford, Jr. | 166/299 |
| 3,174,545 | 3/1965 | Mohaupt | 166/299 |
| 3,393,741 | 7/1968 | Huitt et al. | 166/308 |
| 4,039,030 | 8/1977 | Godfrey et al. | 166/308 X |
| 4,067,389 | 1/1978 | Savins | 166/308 X |
| 4,091,870 | 5/1978 | Godfrey et al. | 166/299 |
| 4,333,461 | 6/1982 | Muller . | |
| 4,391,337 | 7/1983 | Ford et al. | 166/299 X |
| 4,601,339 | 7/1986 | Jennings, Jr. | 166/308 X |
| 4,617,997 | 10/1986 | Jennings, Jr. | 166/308 |
| 4,635,727 | 1/1987 | Anderson et al. | 166/308 |

*Primary Examiner*—George A. Suchfield
*Attorney, Agent, or Firm*—Alexander J. McKillop; Michael G. Gilman; Charles A. Malone

[57] ABSTRACT

A controlled pulse fracturing ("CPF") process where a viscous fluid is used as a tamp or fluid cushion above a propellant device. Use of said fluid increases the vertical drag in the open wellbore thereby maximizing injection into the formation. Increasing the vertical drag during the fracturing procedure maximizes the number, extent, and length of fractures.

15 Claims, 1 Drawing Sheet

USE OF A GEL ABOVE A CONTROLLED PULSE FRACTURING DEVICE

FIELD OF THE INVENTION

This invention is directed to a method for maximizing fracture extent, length, and number when a viscous fluid is used as a fluid cushion during controlled pulse or high energy fracturing.

BACKGROUND OF THE INVENTION

Stimulation of wells through mechanical fracturing can be accomplished by a method known as controlled pulse fracturing or high energy gas fracturing. A good description of this method appears in an article by Cuderman, J. F., entitled "High Energy Gas Fracturing Development," Sandia National Laboratories, SAND 83-2137, October 1983. Using this method enables the multiple fracturing of a formation or reservoir in a radial manner which increases the possibility of contacting a natural fracture. In the practice of this method, a canister containing a propellant is suspended into a wellbore. This canister is placed downhole next to the oil or hydrocarbonaceous fluid productive interval.

The propellant in the canister can belong to the modifed nitrocellulose or the modified and unmodified nitroamine propellant class. Suitable solid propellants capable of being utilized include a double-based propellant known as M-5. It contains nitroglycerine and nitrocellulose. Another suitable propellant is a composite propellant which contains ammonium perchlorate in a rubberized binder. The composite propellant is known as HXP-100 and is purchasable from the Holex Corporation of Hollister, Calif. M-5 and HXP-100 propellants are disclosed in U.S. Pat. No. 4,039,030 issued to Godfrey et al. which is hereby incorporated by reference.

After placing the propellant means for creating multiple fractures into a canister and suspending it downhole near all the oil or hydrocarbonaceous fluid productive interval, it is ignited. Ignition of the propellant means for creating the multiple fractures causes the generation of heat and gas pressure. To contain the generated propellant energy within the wellbore and formation, an aggregate stem, generally composed of cement, is placed above the canister containing the propellant thereby sealing the wellbore. The canister suspension and ignition means passes through the aggregate stem.

After ignition of the propellant means it is difficult to remove the aggregate stem, which often has to be drilled out. When removing the aggregate stem, the suspension means, generally a cable, and the ignition means, along with remnants of the canister which previously contained the propellant, frequently fall into the wellbore. This debris may interfere with production of hydrocarbonaceous fluids from the formation. Drilling out the aggregate often damages the wellbore and formation.

Therefore, what is needed is a method to facilitate removing the cannister suspension and ignition means from the wellbore while increasing the vertical drag during the fracturing procedure so as to maximize the number, extent, and length of fractures.

SUMMARY OF THE INVENTION

This invention is directed to a method for maximizing fluid injection by increasing vertical drag during a controlled pulse fracturing ("CPF") procedure. To accomplish this, a canister containing a propellant is suspended in a viscous fluid within a wellbore near the formation's productive interval. The height of said viscous fluid within said wellbore is sufficient to contain energy released from said propellant and cause an increased vertical drag. Afterwards, the propellant is ignited thereby causing the generation of energy and pressure sufficient in combination with said viscous fluid to initiate more than two initiated fractures are extended and widened by increased vertical drag caused by said viscous fluid.

After ignition, and when conditions in the wellbore and formation have reached the desired level of stability, said viscous liquid can be removed.

It is therefore an object of the present invention to provide a method to facilitate removal of the canister suspension and ignition means, along with any canister remnants, from the wellbore.

It is another object of this invention to provide a method which will facilitate the removal of the stem after ignition of the propellant.

Yet another object of this invention is to provide a method which will facilitate varying the viscosity of the viscous fluid to increase its strength.

Still yet another object of the present invention is to minimize damage to a wellbore or formation when removing the gel plug or stem.

A further object of the present invention is to provide for a method which will allow for increasing the vertical drag via said viscous fluid to maximize fluid injection into a formation thereby increasing the width and length of fractures during a CPF procedure.

DESCRIPTION OF THE PREFERRED EMBODIMENTS

Figure 1:
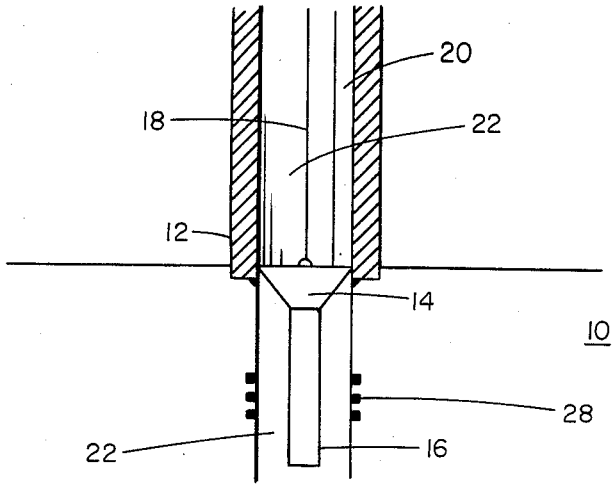
FIG. 1 is a graphic representation of the viscous fluid and canister containing the propellant before ignition.

In the practice of this invention, referring to FIG. 1, a canister 16 containing a propellant is placed into a wellbore 12 which penetrates a hydrocarbonaceous fluid producing formation 10 near the formation's productive interval. Wellbore 12 contains perforations 28 which communicate with the formation's productive interval. Canister 16 is suspended into wellbore 12 in close proximity to the productive interval via a retrieval means, which generally will be a cable 18. A viscous fluid 22 is directed into wellbore 12 thereby immersing canister 16 and thereafter proceding above retainer stem 14. Wellbore 12 is thereby filled with viscous fluid 22. When filled in this manner, viscous fluid 22 servès as a fracturing fluid as well as a tamp for the propellant contained in canister 16. In order to ignite the propellant contained in the canister 16, a means for igniting the propellant is connected to the retainer stem 14. Retainer stem 14 forms an integral part of the canister and is positioned on its upwardly directed end. The other end of the means for ignition is connected or affixed to a location at or above ground level above wellbore 12. Said means for ignition will generally be a conduit 20 containing an electrical wire which wire can be used to generate an electrical spark within canister 16 containing the propellant. Both retrieval means, 18 and ignition means 20 proceed to the surface and through the cap (not shown) on wellbore 12.

Having directed a viscous fluid as a pumpable gel mixture into wellbore 12, after from about 0.5 hours to about 2 hours, the pumpable gel mixture becomes viscous but does not solidify. As will be understood by those skilled in the art, the composition of the mixture can be varied to obtain the desired gel viscosity. One method of making a suitable pumpable mixture is discussed in U.S. Pat. No. 4,333,461 issued to Muller on June 8, 1982 which patent is hereby incorporated by reference. The viscosity of the viscous fluid 22 will depend upon the physical and chemical characteristics of the formation desired to be fractured and the propellant mixture utilized. As is known to those skilled in the art, the viscous fluid should be of a stability and rigidity which will absorb shock from ignition of the propellant contained in the canister 16. In those wellbores deep enough to confirm sufficient viscous material to absorb the detonating propellant, a cap on wellbore will not be needed. Generally, pressures generated upon ignition will vary from about 10,000 psig to about 80,000 psig. Instantaneous heat generated upon ignition of the propellant may be greater than about 1,000° F. in the vicinity of the deflagration but is quickly dissipated with propagation.

Retainer stem 14 forms an integral part of the canister when it is suspended into the wellbore from a location at or above the ground level. Said retainer stem 14 should be composed of a material sufficiently strong to enable it to support viscous fluid 22 suspended thereabove to the height needed to obtain the most effective vertical drag to obtain increased fractures. These fractures will also be further widened and extended into the formation. As expected, this height will vary from about 10 to about 5000 feet.

When using propellants to generate the desired fracturing pressure, it is often desirable to have a viscous fluid 22 which will withstand a temperature range from about 300° F. to about 450° F. for from about 0.5 of a day to about 4 days. A thermally stable viscous fluid 22 can be obtained by mixing into the pumpable gel mixture a chemical known as an oxygen scavenger (such as sodium thiosulfate or short chain alcohols such as methanol, ethanol, and isopropanol), preferably sodium thiosulfate. The concentration of the oxygen scavenger utilized, of course, will depend upon the thermal stability desired to be obtained for viscous fluid 22. However, as preferred, it is anticipated that the concentration of the oxygen scavenger in the pumpable gel mixture will be from about 0.10 percent by weight to about 0.75 percent by weight, preferably 0.50 percent by weight.

Figure 2:
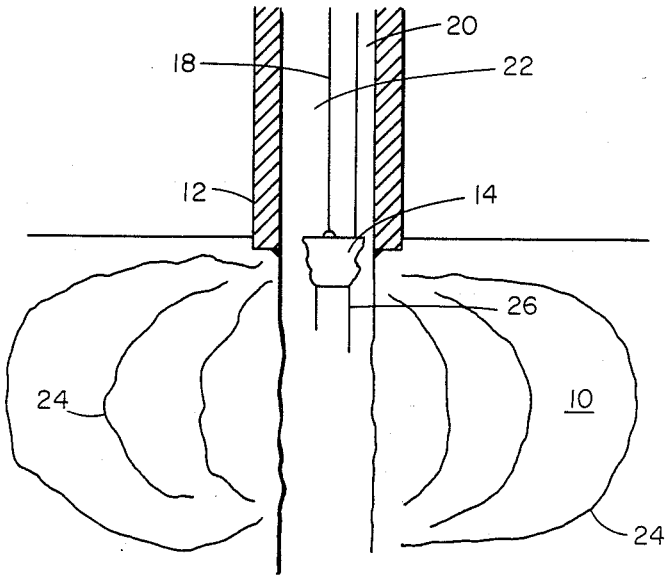
FIG. 2 is a graphic representation of the viscous fluid and canister containing the propellant after ignition.

Upon ignition of the propellant, heat and pressure are released within wellbore 12 thereby forcing viscous fluid 22 into formation 10 which fractures said formation. The increased vertical drag of said viscous fluid during the fracturing procedure maximizes the number, extent, and length of fractures. It also maximizes fluid injection into the wellbore. As shown in FIG. 2, this heat and pressure produced at a controlled rate causes a fracturing of the hydrocarbonaceous producing formation 10. Fracturing of the formation is indicated by lines 24 in FIG. 2. Upon ignition, the heat and pressure created by the propellant causes a total or partial disintegration of canister 26 which contained the propellant. However, as shown in FIG. 2, retrieval cable 18 and ignition line 20 remain intact.

Removal of retrieval cable 18, and ignition line 20 along with any remaining parts of retainer stem 14 is facilitated when viscous fluid 22 is utilized. The viscosity of viscous fluid 22 is sufficiently low so that said cable 18, ignition line 18, and any remnant of stem 14 can be easily brought to the surface. Viscous fluid 22, after ignition, flows into wellbore 12 where it can be removed by any suitable physical means such as pumping tothe surface. After any debris and viscous fluid have been removed from the wellbore, hydrocarbonaceous fluids an be produced from a formation when the created fractures intersect a natural hydrocarbonaceous fluid containing fracture.

The vertical drag in the open wellbore, caused when viscous fluid 22 was intact prior to ignition of the propellant, serves to enhance the penetration of pressurized liquid and gases into formation 10 thereby causing said fractures to lengthen and widen. Propellants which may be utilized herein are discussed in U.S. Pat. No. 4,601,339 which issued to Jennings, Jr. on July 22, 1986. This patent is hereby incorporated by reference herein.

In another embodiment of this invention, a coupling fluid is directed into wellbore 12 to a height sufficiently level with intact retainer stem 14 so as to submerge propellant 16 therein. Upon igniting propellant 16, the high pressure generated causes shock waves to be generated in the coupling fluid which in combination with the vertical drag from viscous fluid 22 causes the initiated fractures to be extended and widened even further. Oil, kerosene, or water are disclosed for use as coupling fluids in U.S. Pat. No. 4,039,030 issued to Godfrey et al. on Aug. 2, 1977. This patent is hereby incorporated by reference.

A coupling fluid which can be used in this method includes an aqueous solution of an interaction product of a polysaccharide and a galactomannan. This interaction product is disclosed in U.S. Pat. No. 4,067,389 which issued to Savins on Jan. 10, 1978. This patent is hereby incorporated by reference.

Athough the present invention has been described with preferred embodiments, it is to be understood that modifications and variations may be resorted to without departing from the spirit and scope of this invention as those skilled in the art will readily understand. Such modifications and variations are considered to be within the purview and scope of the appended claims.

What is claimed is:

1. A method for maximizing fluid injection into a formation wherein vertical drag is increased during a controlled pulse fracturing ("CPF") procedure comprising:

(a) directing a gel in liquid form into a wellbore substantially above the productive interval of said formation to a height sufficient to contain energy released from a propellant during a controlled pulse fracturing procedure;

(b) suspending a cannister containing a propellant therein into wellbore substantially near said productive interval; and (c) igniting said propellant thereby causing the generation of energy and pressure sufficient to initiate simultaneous multiple vertical fractures in the formation which fractures are extended and widened by increased vertical drag caused by said gel.

2. The method as recited in claim 1 where the viscosity of said gel can be varied to increase the vertical drag of said gel.

3. The method as recited in claim 1 where said gel is capable of withstanding pressure released from said propellant of from about 10,000 to about 80,000 psig.

4. The method as recited in claim 1 where said gel is capable of withstanding a temperature greater than about 1,000° F.

5. The method as recited in claim 1 where the height of the gel contained in said wellbore is about 10 to about 5000 feet.

6. The method as recited in claim 1 where the height of the gel contained in said wellbore is about 10 to about 5000 feet and said fluid serves as a tamp as well as a fracturing fluid.

7. The method as recited in claim 1 whereafter step (c) any remaining debris and gel are removed from said wellbore and hydrocarbonaceous fluid is produced from the formation.

8. A method for maximizing fluid injection into a formation wherein vertical drag is increased during a controlled pulse fracturing ("CPF") procedure comprising;

(a) directing a coupling fluid into a wllbore substantially above the productive interval of said formation and a gel in liquid form thereabove to a height sufficient to contain energy released from a propellant during a controlled pulse fracturing procedure;

(b) suspending a cannister containing a propellant therein said coupling fluid into saidwellbore substantially near said productive interval; and (c) igniting said propellant thereby causing the generation of energy and pressure sufficient to initiate more than two simultaneous vertical fractures in the formation which fractures are extended and widened by increased vertical drag caused by said gel acting in combination with said coupling fluid.

9. The method as recited in claim 8 where the viscosity of said gel can be varied to increase the vertical drag of said fluid.

10. The method as recited in claim 8 where said gel is capable of withstanding pressure released from said propellant of from about 10,000 to about 80,000 psig.

11. The method as recited in claim 8 where said gel is capable of withstanding a temperature greater than about 1,000° F.

12. The method as recited in claim 8 where the height of the gel column is about 10 to about 5000 feet.

13. The method as recited in claim 8 where the height of the gel contained in said wellbore is about 10 to about 5000 feet and said fluid serves as a tamp as well as a fracturing fluid.

14. The method as recited in claim 8 where in step (b) said coupling fluid comprises an interaction product of a polysaccharide and a galactomannan.

15. The method as recited in claim 8 where after step (c) any remaining debris and gel are removed from said wellbore and hydrocarbonaceous fluid is produced from the formation.

* * * * *